United States Patent [19]

Asanuma et al.

[11] Patent Number: 4,762,471

[45] Date of Patent: Aug. 9, 1988

[54] ROTARY COMPRESSOR FOR REFRIGERANT

[75] Inventors: Hajime Asanuma, Fuji; Masatsugu Tokairin, Shizuoka, both of Japan

[73] Assignee: Kabushiki Kaisha Toshiba, Kawasaki, Japan

[21] Appl. No.: 794,540

[22] Filed: Nov. 4, 1985

[30] Foreign Application Priority Data

Nov. 6, 1984 [JP] Japan ..... 59-168216[U]

[51] Int. Cl.[4] ..... F04B 39/02

[52] U.S. Cl. ..... 417/372; 417/902; 418/DIG. 1; 184/6.18; 310/60 R

[58] Field of Search ..... 417/902, 372; 418/DIG. 1; 184/6.16, 6.18, 6.22; 310/54, 58, 60 R

[56] References Cited

U.S. PATENT DOCUMENTS

| | | | |
|---|---|---|---|
| 1,857,276 | 9/1932 | Gibson et al. | 418/DIG. 1 X |
| 1,967,034 | 7/1934 | Lipman | 418/DIG. 1 X |
| 2,093,811 | 9/1937 | Kucher | 417/372 X |
| 2,113,691 | 4/1938 | Heller | 417/372 X |
| 2,124,239 | 7/1938 | Smith | 417/902 X |
| 3,922,114 | 11/1975 | Hamilton et al. | 418/DIG. 1 X |
| 4,181,474 | 1/1980 | Shaw | 417/372 X |
| 4,592,703 | 6/1986 | Inaba et al. | 417/366 |

FOREIGN PATENT DOCUMENTS

| | | | |
|---|---|---|---|
| 58-170893 | 10/1983 | Japan | 418/DIG. 1 |
| 60-53691 | 3/1985 | Japan | 418/DIG. 1 |
| 676502 | 7/1952 | United Kingdom | 417/372 |
| 766038 | 1/1957 | United Kingdom | 417/372 |
| 916021 | 1/1963 | United Kingdom | 417/372 |

*Primary Examiner*—Leonard E. Smith
*Assistant Examiner*—Ted Olds
*Attorney, Agent, or Firm*—Foley & Lardner, Schwartz, Jeffery, Schwaab, Mack, Blumenthal & Evans

[57] ABSTRACT

In a rotary compressor for refrigerants of the type having, within a sealed case, a refrigerant compressing device and a motor disposed thereabove for driving the same and having a vertical rotor shaft, an oil-separating member of umbrella shape with a downwardly-directed peripheral rim is disposed coaxially above and fixed relative to the top end of the rotor and functions to guide compressed refrigerant containing lubricating oil particles toward and through the motor windings of the motor thereby to separate the oil particles from the refrigerant, which is then delivered under pressure.

9 Claims, 2 Drawing Sheets

ROTARY COMPRESSOR FOR REFRIGERANT

BACKGROUND OF THE INVENTION

This invention relates generally to the refrigeration systems of cooling appliances such as air conditioners, refrigerators, and refrigeration plants and more particularly to rotary compressors for compressing refrigerants in such refrigeration systems. More specifically, the invention concerns a device for separating compressed refrigerant and lubricating oil in a rotary compressor of this type.

In general, a rotary compressor of the instant type is of a construction wherein a rotary compressing device and an electric motor for driving the compressing device are completely enclosed within a sealed case, the motor occupying the upper part of the case and the compressing device being disposed in the lower part, the bottom of which forms a sump tank for lubricating oil used in lubricating the moving parts of the compressing device. A gaseous refrigerant to be compressed is supplied from the outside, compressed by the compressing device, sent upward through the rotor of the motor and delivered out of the case through a delivery pipe at its top. A portion of the lubricating oil in the form of misty particles is swept upward by the flow of the gaseous refrigerant and must be separated from the refrigerant to be delivered out of the case.

In a typical known compressor of this type, a planar disk is mounted on the upper end of the vertical rotor shaft for directing the flow of the refrigerant and the oil particles toward an annular end coil of the motor stator, the object being to cause the refrigerant and oil to pass through the end coil thereby to accomplish the above mentioned separation of oil. In actual practice, however, a portion of the refrigerant plus oil tend to flow upward through the clearance gap between the outer periphery of the planar disk and the inner side of the end coil without passing through the end coil. Consequently, the oil particles remain in the gaseous refrigerant and are sent therewith to the succeeding component (i.e., condenser) in the refrigeration circuit, whereby the quantity of lubricating oil in the rotary compressor assembly is depleted.

As a consequence, the lubrication performance drops, and there arises the possibility of serious results such as overheating due to excessive friction of moving parts and damage and breakage thereof and lowering of the compressing efficiency.

SUMMARY OF THE INVENTION

With the aim of solving the above described basic problem, this invention seeks to provide a rotary compressor for refrigerants in which the oil-separating member is improved to separate lubricating oil with high efficiency from the refrigerant, and at the same time the lubrication efficiency is improved.

According to this invention, briefly summarized, there is provided a rotary compressor for a refrigerant of the type having a sealed case which has an oil reservoir in the bottom thereof, an electric motor installed in the upper part of the case and comprising a stator with an annular end coil at the upper part thereof and a rotor rotatably supported within the stator, a vertical rotor shaft fixed to the rotor and a compressing device disposed in the lower part of the case and driven by the rotor shaft to compress the refrigerant, which is then sent upward, together with particles of lubricating oil, through passages in the rotor to a space thereabove, the improvement comprising an oil-separating member of approximately umbrella shape with a downwardly directed peripheral rim, said oil-separating member being disposed coaxially above and fixed relative to the upper end of the rotor and functioning to positively direct the compressed refrigerant thus sent to said space toward and through the end coil, whereby the particles of lubricating oil are separated from the refrigerant, which is then delivered under pressure out of the rotary compressor.

The nature, utility, and further features of this invention will be more clearly apparent from the following detailed description with respect to preferred embodiments of the invention when read in conjunction with the accompanying drawings, briefly described below.

DETAILED DESCRIPTION OF THE INVENTION

Figure 7:
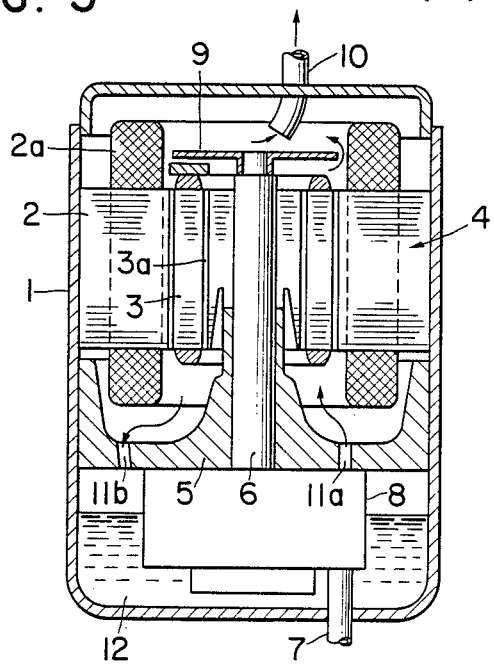
FIG. 7 PRIOR ART
FIG. 7 is an elevation similar to FIG. 1 showing an example of a known rotary compressor.

As conducive to a full understanding of this invention, the general nature, attendant problem, and limitation of a known rotary compressor of the instant type will first be described with reference to FIG. 7.

The operational parts of this known rotary compressor are enclosed within a sealed case 1. In the upper half of this case 1 is disposed a motor 4 comprising essentially a stator 2 provided with end coils 2*a*, a rotor 3, a vertical rotor shaft 6 integrally and coaxially fixed to the rotor 3, and a bearing structure 5 rotatably supporting the rotor shaft 6 at its lower end. Below the bearing structure 5 is provided a rotary compressing device 8 coupled to and driven by the rotor shaft 6 and connected to a refrigerant suction pipe 7. Furthermore, as described in Japanese Utility Model Laid-Open publication No. 165981/1980, a disk-shaped oil-separating plate 9 is mounted coaxially on the upper end of the rotor shaft 6 at a position above the rotor 3, and a delivery pipe 10 for discharging refrigerant is provided to communicate with a space in the upper part of the case 1 and to extend out through the upper end plate of the case 1.

In the operation of the above described rotary compressor, the rotary compressing device 8 is driven in rotation by the rotor shaft 6 when the motor 4 is started. The gaseous refrigerant is thereby drawn through the refrigerant suction pipe 7 and into the compressing device 8 where it is compressed. The compressed refrigerant is then discharged once into the central part of the interior of the case 1 below the rotor 3 through gas discharge holes 11*a* formed in parts of the bearing structure 5. Further, the discharged gaseous refrigerant with lubricating oil particles admixed therewith is passed through passages 3*a* formed in the rotor 3 and collides with the lower surface of the oil-separating plate 9 to be directed radially outward toward the upper end coil 2a. As the refrigerant passes through the end coil 2a, the lubricating oil particles are separated from the refrigerant. The refrigerant which has passed through this end coil 2a is delivered under pressure through the delivery pipe 10 to a condenser (not shown) constituting a component in the refrigeration circuit. On the other hand, the separated lubricating oil is caused to descend and, passing through holes 11b in the bearing structure 5, circulates into a sump tank or an oil reservoir 12 formed at the bottom of the case 1.

In the above described known rotary compressor, however, the oil-separating plate 9 is simply of disk shape. For this reason, a portion of the refrigerant directed along the lower surface of this oil-separating plate 9 toward the end coil 2a does not pass through the end coil 2a but flows through the clearance gap between the outer peripheral edge of the oil-separating plate 9 and the inner side of the end coil 2a, and, in actuality, effective separation of the lubricating oil has been difficult in this known compressor. As a consequence, an undesirably large quantity of the lubricating oil is delivered together with the refrigerant, to the succeeding parts of the refrigeration circuit, whereby the oil level in the sump tank 12 drops, and the oil supplying performance is thereby lowered. This defective operational state gives rise to the possibility of undesirable consequences such as overheating due to excessive friction in parts such as the bearing 5 and sliding parts, which can lead to damage and breakage of parts and lowering of the compressing efficiency.

This invention, which provides a solution to the above described problem, will now be described with respect to preferred embodiments thereof and with reference to FIGS. 1 through 4.

Figure 1:
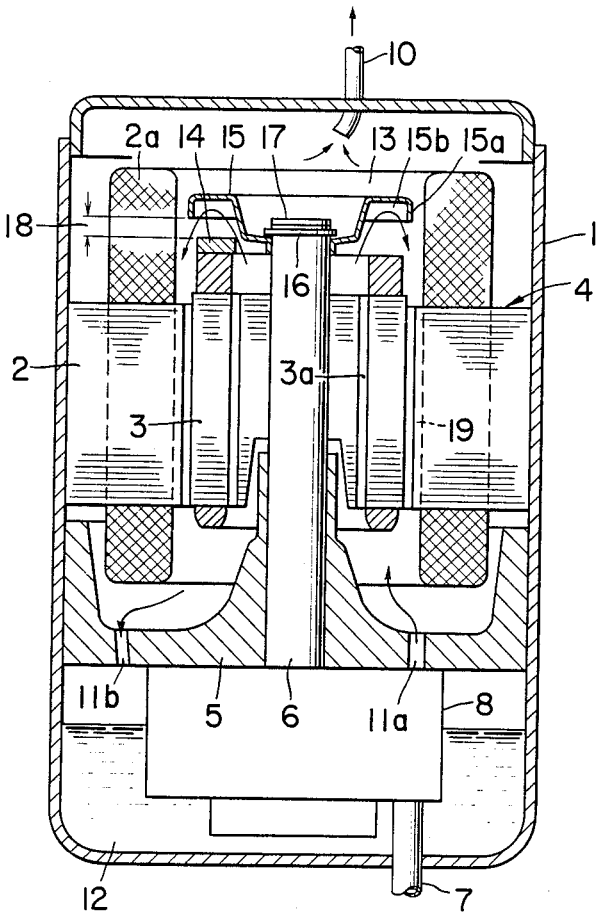
FIG. 1 is an elevation, in vertical section, showing an example of a rotary compressor according to this invention.

Referring first to FIG. 1, the rotary compressor according to this invention has a sealed cylindrical case structure 1 accommodating in the upper half portion thereof an electric motor 4 comprising a stator 2 and a rotor 3. The rotor 3 is coaxially fixed to a vertical rotor shaft 6, which is rotatably supported by a bearing structure 5 fixed to the inner wall surface of the case structure 1 at a position below the motor 4. Below the bearing structure 5 is installed a rotary compressing device 8 coupled to and driven by the lower end of the shaft 6 and having a refrigerant suction pipe 7.

On the upper part of the stator 2 is provided an annular end coil 2a, on the inner side of which is formed a space 13. Within this space 13 and on the upper end of the rotor 3, a balance weight 14 is mounted for attaining rotational balance of the rotor 3. The above described parts and their structural arrangement are essentially the same as those of the typical known rotary compressor described hereinbefore and illustrated in FIG. 5.

According to this invention, an oil-separating member 15 of the shape of a surface of revolution with a downwardly facing annular trough 15b formed in part by a downwardly hanging peripheral rim 15a as shown in FIG. 1, which may be roughly called an umbrella shape, is mounted coaxially on the upper end of the rotor shaft 6 in the vicinity of the balance weight 14 and is secured in place by a corrugated washer 16 and a snap ring 17. A spacing gap 18 of the order, for example, of 2 to 10 mm is provided between the lower edge of the peripheral rim 15a and the upper face of the balance weight 14 mounted on the rotor 3.

We have found that if this spacing gap 18 is made greater than 10 mm, the distance to the oil return passages (i.e., stator slots) 19 becomes large, and the effectiveness of separating the lubrication oil will drop. On the other hand, if this spacing gap 18 becomes less than 2 mm, the resistance to the flow of the discharged refrigerant through this spacing gap will increase, whereby the compressing efficiency will drop, and at the same time the noise arising from the refrigerant flowing sound will increase. Accordingly, we have found as a result of experiments that the above stated range of 2 to 10 mm is desirable. In the case where a balance weight is not used on the rotor 3, the spacing gap between the upper face of the rotor 3 (i.e., upper face of the end ring) and the lower edge of the peripheral rim 15a is selected in the above stated range.

In the rotary compressor of the above described construction according to this invention, the compressed refrigerant carrying lubricating oil mixed therein flows upward through gas discharge holes 11a formed in the bearing structure 5 and, passing upward through gas passages 3a formed vertically through the rotor 3, is urged to flow toward the delivery pipe 10. However, this refrigerant once impinges against the lower surface of the oil-separating member 15 disposed in the sapce 13 on the inner side of the end coil 2a. Then, since the oil-separating member 15 has the above described shape, the refrigerant thus coming into contact therewith is guided thereby as indicated by arrows toward the lower part of the end coil 2a, that is, toward the upper parts of the oil return passages 19.

As a result, the discharged refrigerant with the oil particles positively passes through the end coil 2a, and, as it does so, the lubricating oil particles contained therein are separated therefrom. The refrigerant from which the lubricating oil has been separated in this manner is delivered under pressure through the delivery pipe 10 to a condenser (not shown) constituting a part of the refrigeration circuit.

On the other hand, the separated lubricating oil flows downward through the oil return passages 19 and returns to the oil sump tank 12.

Figure 2:
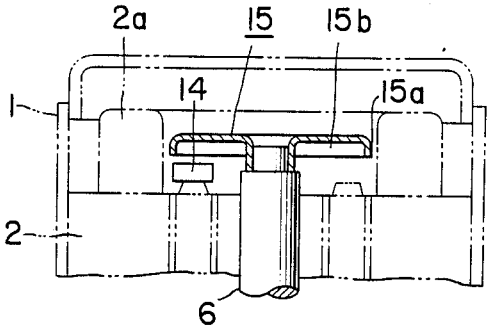
FIG. 2 is an elevation similar to FIG. 1 showing the rotary compressor with another example of the oil-separating member.

In another embodiment of the invention as illustrated in FIG. 2, the oil-separating member 15 is also of umbrella shape, which is more like an inverted circular tray with a downwardly pending rim 15a and a downwardly-facing annular trough formed in part by said rim 15a. By this shape of the oil-separating member 15, the flow of the refrigerant and lubricating oil particles contained therein is forcibly directed downward at the rim 15a, whereby the separation efficiency is improved.

Figure 3:
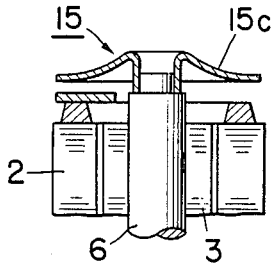
FIGS. 3 and 4 are partial elevations, with parts in vertical section, respectively showing further examples of the oil-separating member.

In still another embodiment of the invention as shown in FIG. 3, the oil-separating member 15 is of a reflexed umbrella shape with an inclined inner and lower surface which directs the flow of the refrigerant gas and lubricating oil particles downward, thereby improving the separation efficiency.

Figure 4:
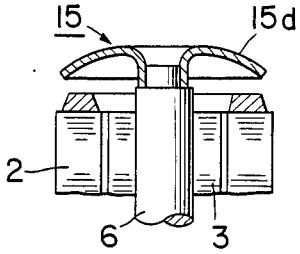

In a further embodiment of the invention shown in FIG. 4, the oil-separating member 15 is of dome shape resembling an umbrella. The concave curved inner surface of this member 15 directs the flow of the refrigerant and lubricating oil downward thereby to improve the separation efficiency.

While, in the preceding examples of this invention, the oil-separating member 15 has been described as being fixedly mounted on the upper end of the rotor shaft 6, the invention is not intended to be so limited but is inclusive of other constructional arrangements wherein the oil-separating member is disposed coaxially above and fixed relative to the upper end of the rotor.

Figure 5:
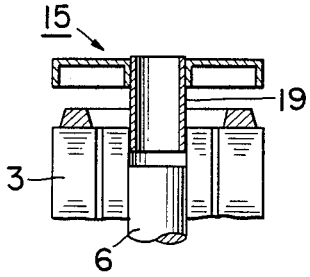
FIGS. 5 and 6 are partial elevations, with parts in vertical section, respectively showing other modes of mounting of the oil-separating member.
Figure 6:
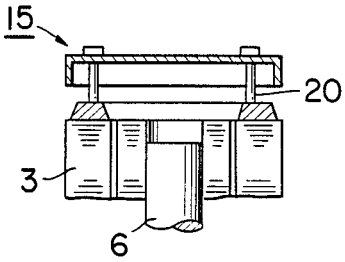

For example, as shown in FIG. 5, the oil-separating member can be fixedly mounted coaxially on the upper end of a stem 19, which is in turn coaxially fixed to the upper end of the rotor 3 independently of the rotor shaft 6. The stem 19 in this particular example is shown as being hollow. In another example as shown in FIG. 16, the oil-separating member is disposed coaxially above the rotor 3 but is fixed relative thereto by a plurality of stud pins 20.

What is claimed is:

1. A rotary compressor for a refrigerant comprising:

(a) a sealed case;

(b) an oil reservoir disposed in the lower part of the said sealed case;

(c) an electric motor disposed in the upper part of said sealed case, said electric motor comprising a stator having an annular end coil at the upper part of said electric motor, a rotor rotatably supported within said stator, and a vertical rotor shaft fixed to said rotor;

(d) a compressing device disposed in the lower part of said sealed case, said compressing device being driven by said rotor shaft to compress said refrigerant, said compressed refrigerant being sent upward, together with particles of lubricating oil, through passages in said rotor to a space thereabove;

(e) refrigerant and lubricating oil flow reversal means for separating said lubricating oil from said refrigerant, said separating means disposed coaxially above and fixed relative to the upper end of said rotor, and positively directing said compressed refrigerant toward and through said end coil with a downward component of direction, whereby said particles of lubricating oil are substantially separated from said refrigerant, and wherein said separating means is an approximately umbrella shaped member having a downwardly-directed and circumferentially continuous peripheral rim; and (f) a delivery pipe disposed in the upper part of said sealed case, which provides an exit for said substantially lubricating oil particle free compressed refrigerant.

2. In a rotary compressor for a refrigerant of the type having a sealed case which has an oil reservoir in the bottom thereof, an electric motor installed in the upper part of the case and comprising a stator with an annular end coil at the upper part thereof, and a rotor rotatably supported within the stator, a vertical rotor shaft fixed to the rotor and a compressing device disposed in the lower part of the case and driven by the rotor shaft to compress the refrigerant, which is then sent upward, together with particles of lubricating oil, through passages in the rotor to a space thereabove, the improvement comprising an oil-separating member of approximately umbrella shape having a wall member including a downwardly-directed and circumferentially continuous wall section which forms therewithin a downwardly opening recess, said oil-separating member being disposed coaxially above and fixed relative to the upper end of said rotor, said wall section positively directing the compressed refrigerant thus sent to said space toward and through the end coil with a downward component of direction, whereby said particles of lubricating oil are separated from said refrigerant, said refrigerant then delivered under pressure out of the rotary compressor.

3. A rotary compressor as claimed in claim 2 wherein said wall section comprises a peripheral rim.

4. A rotary compressor as claimed in claim 3 in which the oil-separating member has the shape of a surface of revolution with a downwardly-facing annular trough formed in part by said downwardly-directed, circumferentially continuous peripheral rim.

5. A rotary compressor as claimed in claim 2 in which the oil-separating member has the shape of an inverted circular tray with a central stem part directed downward and fixed at its lower part to the rotor.

6. A rotary compressor as claimed in claim 2 in which the oil-separating member has the shape of a reflexed umbrella with an inclined inner and lower surface and a central stem part fixed at its lower end to the rotor.

7. A rotary compressor as claimed in claim 2 in which the oil-separating member is of dome shape resembling an umbrella and has a central stem part fixed at its lower end to the rotor.

8. A rotary compressor as claimed in claim 3 in which a gap of 2 to 10 mm is provided between the downwardly-directed, circumferentially continuous peripheral rim of the oil-separating member and the upper surface of the rotor.

9. A rotary compressor as claimed in claim 3 in which the uppermost part of the rotor includes a balance weight secured thereon and a gap of 2 to 10 mm is provided between the downwardly-directed, circumferentially continuous peripheral rim of the oil-separating member and the balance weight.

* * * * *